US007816597B2

(12) United States Patent
Okada et al.

(10) Patent No.: US 7,816,597 B2
(45) Date of Patent: Oct. 19, 2010

(54) DRUM PAD AND MANUFACTURING METHOD THEREOF

(75) Inventors: Masuhiro Okada, Kikugawa (JP); Shuichi Sawada, Hamamatsu (JP)

(73) Assignee: Yamaha Corporation (JP)

( * ) Notice: Subject to any disclaimer, the term of this patent is extended or adjusted under 35 U.S.C. 154(b) by 15 days.

(21) Appl. No.: 12/414,064

(22) Filed: Mar. 30, 2009

(65) Prior Publication Data

US 2009/0241754 A1 Oct. 1, 2009

(30) Foreign Application Priority Data

Mar. 31, 2008 (JP) ..... 2008-089284

(51) Int. Cl.
*G10D 13/02* (2006.01)

(52) U.S. Cl. ..... 84/414; 84/411 R

(58) Field of Classification Search ..... 84/414, 84/411 R, 411 M
See application file for complete search history.

(56) References Cited

U.S. PATENT DOCUMENTS 5,986,196 A * 11/1999 Behrenfeld ..... 84/411 M
6,063,992 A * 5/2000 Schwagerl ..... 84/411 R
7,439,432 B2 * 10/2008 Hiraku ..... 84/414
7,465,869 B1 * 12/2008 Freitas ..... 84/723
2005/0109190 A1 * 5/2005 Smith et al. ..... 84/414
2007/0184238 A1 * 8/2007 Hockaday et al. ..... 428/98

FOREIGN PATENT DOCUMENTS

JP 2005-227535 A 8/2005
JP 2005-250340 A 9/2005

* cited by examiner

*Primary Examiner*—Jianchun Qin
(74) *Attorney, Agent, or Firm*—Rossi, Kimms & McDowell LLP

(57) ABSTRACT

A drum pad has a knitted material that is strechable and has a top surface to be beaten by a stick and a rear surface opposite to the top surface, a resin member that is strechable and thinner than the knitted material and that is capable of being thermally fused and bonded to the knitted material, and a rubber. The drum pad is formed of a first layer portion, a second layer portion, and a body portion. The first layer portion is formed in a region of the knitted material including the top surface thereof but not including the rear surface. The body portion is formed of the rubber. The second layer portion is formed in a remaining region of the knitted material other than the first layer portion and formed between the body portion and the first layer portion.

12 Claims, 5 Drawing Sheets

DRUM PAD AND MANUFACTURING METHOD THEREOF

BACKGROUND OF THE INVENTION

1. [Technical Field]

The present invention relates to a drum pad used as a pad of an electronic drum or a practice pad and a method of manufacturing the same.

2. [Background Art]

Conventionally, drum pads used for electronic drums and the like were known. Regarding such a kind of drum pads, there is a need for a beating feeling close to an acoustic drum pad as much as possible. Since an electronic drum electronically generates musical sounds, an actual beating sound resulting from beating a drum pad should be as small as possible so as not to disturb the electronic sound, and therefore sound-reducing ability is also important.

In an electronic drum pad described in Patent Document 1, a body portion formed of a polymer material is covered with a surface layer portion, and the surface layer portion is formed by adhesion or fusion-bonding of a film, a sheet, a woven cloth, or a knitted cloth. Accordingly, in addition to accomplishing quietness and a beating feeling, it is possible to suppress the deterioration of the body portion by not exposing the body portion to external air.

In an electronic drum pad described in Patent Document 2, a compensation member formed of a crossed material such as woven cloth or unwoven cloth of resin fiber is disposed on the surface of a pad body. A material of the pad body may be impregnated in the lower portion of the correction member. Accordingly, the rebounding and returning direction of a stick is similar to that of an acoustic drum, thereby embodying a natural beating feeling.

[Patent Document 1]

Japanese Patent Application Laid-Open No. 2005-250340

[Patent Document 2]

Japanese Patent Application Laid-Open No. 2005-227535

However, in the electronic drum pad described in Patent Document 1, the rebounding and returning direction of a stick is not similar to that of the acoustic drum. Since the body portion is protected by only the single surface layer portion, there is a problem that the resistance to the beating impact on the beating surface is not enough.

On the other hand, in the electronic drum pad described in Patent Document 2, the beating feeling is good, but there is a problem that contaminations can be easily caused on the beating surface because the crossed material is exposed from the beating surface.

The materials of the pad body portion have been studied, and there is a need for studying how satisfactorily to bond the material of the surface layer portion to the pad body portion by adhesion or the like in consideration of the material employed for the pad body portion.

SUMMARY OF THE INVENTION

The invention is contrived to solve the above-mentioned problems. An object of the invention is to provide a drum pad that can prevent contamination of a beating surface, maintain durability, and embody a natural and good beating feeling, and a method of manufacturing the drum pad.

To accomplish the above-mentioned object, a drum pad according to the invention comprises: a knitted material that is strechable and has a top surface to be beaten by a stick and a rear surface opposite to the top surface; a resin member that is strechable and thinner than the knitted material and that is capable of being thermally fused and bonded to the knitted material; and a rubber, wherein the drum pad has a first layer portion, a second layer portion, and a body portion, wherein the first layer portion is formed in a region of the knitted material including the top surface thereof but not including the rear surface, and is permeated with the melted resin member such that the resin member and the knitted material monolithically solidify with each other, the body portion is formed of the rubber, and the second layer portion is formed in a remaining region of the knitted material other than the first layer portion and formed between the body portion and the first layer portion, the second layer portion being impregnated with the rubber such that the body portion is bonded to the rear surface of the knitted material.

To accomplish the above-mentioned object, another drum pad according to the invention comprises: an unwoven cloth that is strechable and has a top surface to be beaten by a stick and a rear surface opposite to the top surface; a resin member that is strechable and thinner than the unwoven cloth material and that is capable of being thermally fused and bonded to the unwoven cloth; and a rubber, wherein the drum pad has a first layer portion, a second layer portion, and a body portion, wherein the first layer portion is formed in a region of the unwoven cloth including the top surface thereof but not including the rear surface, and is permeated with the melted resin member such that the resin member and the unwoven cloth monolithically solidify with each other, the body portion is formed of the rubber, and the second layer portion is formed in a remaining region of the unwoven cloth other than the first layer portion and formed between the body portion and the first layer portion, the second layer portion being impregnated with the rubber such that the body portion is bonded to the rear surface of the unwoven cloth.

To accomplish the above-mentioned object, according to the invention, there is provided a method of manufacturing a drum pad including a knitted material that is strechable and that has a top surface to be beaten by a stick and a rear surface opposite to the top surface, a resin member that is strechable and thinner than the knitted material and that is capable of being thermally fused and bonded to the knitted material, and a rubber, wherein the method comprises: a thermal fusion and bonding process of thermally fusing and bonding the resin member to the top surface of the knitted material and forming a first layer portion by allowing the melted resin member to permeate a region of the knitted material including the top surface but not including the rear surface of the knitted material so that the resin member and the knitted material monolithically solidify with each other; and a molding process of forming a second layer portion impregnated with the rubber in a remaining region of the knitted material other than the first layer portion and concurrently forming a body portion with the rubber below the second layer portion oppositely to the first layer portion, and bonding the body portion to the rear surface of the knitted material by casting liquid resin material or thermally-softened non-vulcanized rubber as material of the rubber from the rear surface above which the first layer portion is formed.

To accomplish the above-mentioned object, according to the invention, there is provided another method of manufacturing a drum pad including an unwoven cloth that is strechable and that has a top surface to be beaten by a stick and a rear surface opposite to the top surface, a resin member that is strechable and thinner than the unwoven cloth and that is capable of being thermally fused and bonded to the unwoven cloth, and a rubber, wherein the method comprises a thermal fusion and bonding process of thermally fusing and bonding the resin member to the top surface of the unwoven cloth and forming a first layer portion by allowing the melted resin member to permeate a region of the unwoven cloth including the top surface but not including the rear surface of the unwoven cloth so that the resin member and the unwoven cloth monolithically solidify with each other; and a molding process of forming a second layer portion impregnated with the rubber in a remaining region of the unwoven cloth other than the first layer portion and concurrently forming a body portion with the rubber below the second layer portion oppositely to the first layer portion, and bonding the body portion to the rear surface of the unwoven cloth by casting liquid resin material or thermally-softened non-vulcanized rubber as material of the rubber from the rear surface above which the first layer portion is formed.

It is preferable that the rubber is foamed rubber or silicon rubber having a siloxane bond.

According to the invention, it is possible to prevent the contamination of the beating surface and to maintain the durability and it is also possible to embody a natural and good beating feeling.

According to the invention, it is possible to effectively obtain a beating surface softly rebounding.

According to the invention, it is easy to cast liquid rubber and it is possible to effectively manufacture a drum pad excellent in rebounding property and weathering resistance.

DETAILED DESCRIPTION OF THE INVENTION

Hereinafter, embodiments of the invention will be described with reference to the accompanying drawings.

First Embodiment

Figure 1:
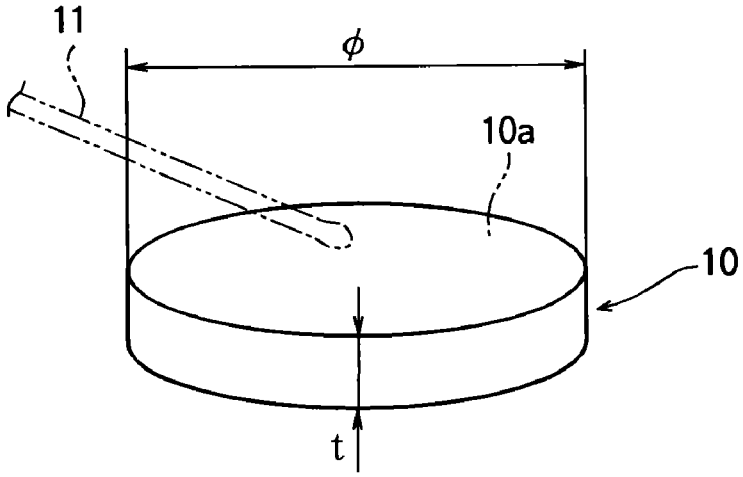
FIG. 1(*a*) is a perspective view schematically illustrating a drum pad according to a first embodiment of the invention and FIG. 1(*b*) is a sectional view schematically illustrating a configuration of the drum pad.
Figure 1:
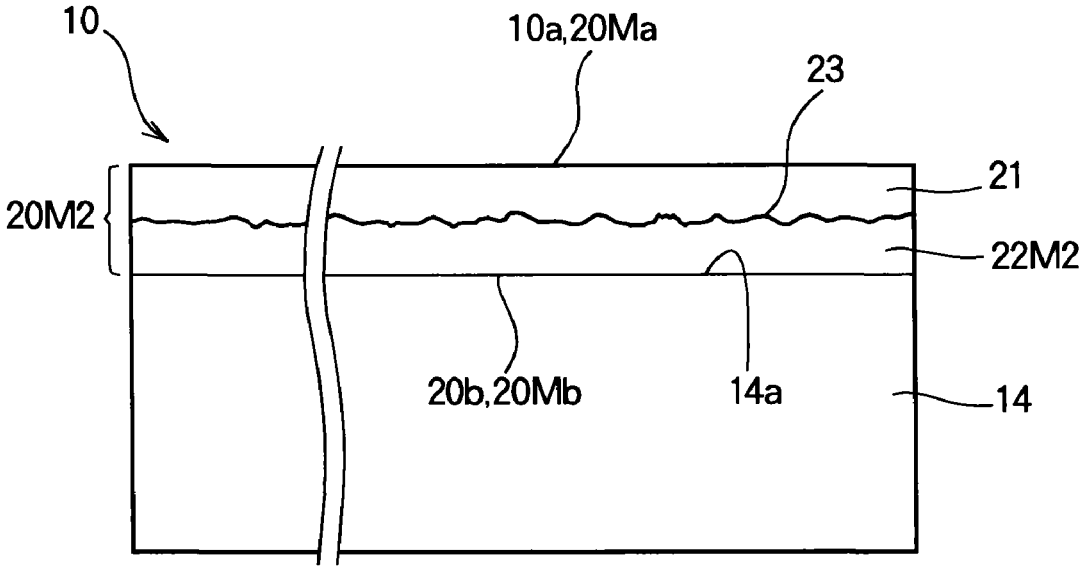
Figure 2A:
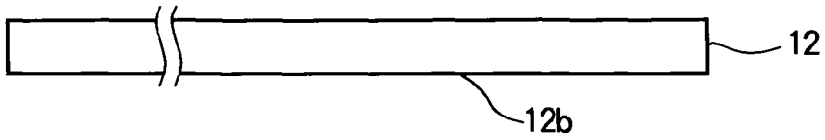
FIGS. 2(*a*), 2(*b*), and 2(*c*) are sectional views illustrating a first surface material, a second surface material, and a temporary composite layer, and FIG. 2(*d*) is a sectional view illustrating a molding process using a mold.
Figure 2B:
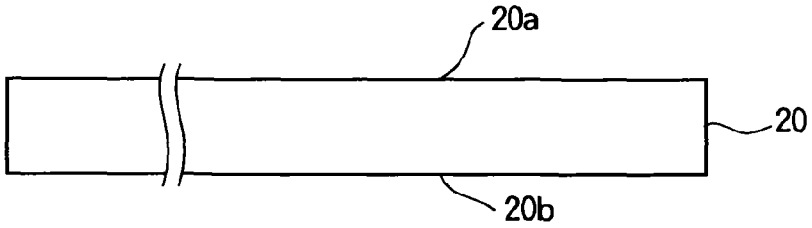
Figure 2C:
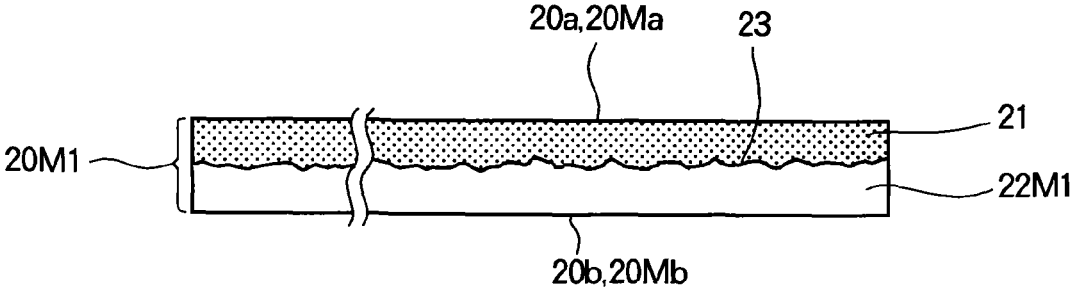
Figure 2D:
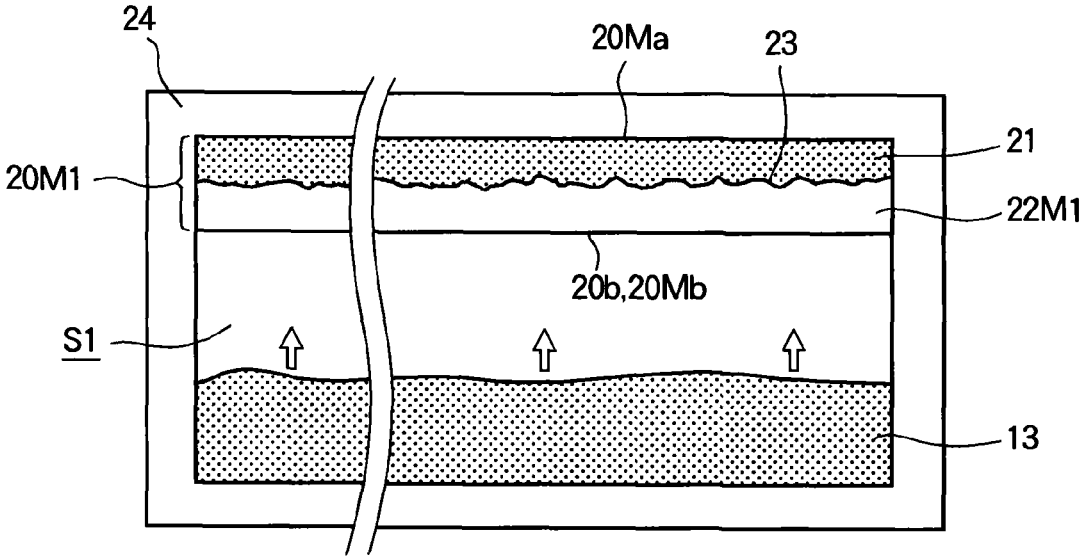

FIG. 1(*a*) is a perspective view schematically illustrating a drum pad according to a first embodiment of the invention. The drum pad 10 is applied to, for example, an electronic drum pad or a beating input device receiving beating data and generating sound generating data and is beaten with a stick 11 or the like. However, the invention is not limited to the above-mentioned examples, but may be used for a beating practice with only the drum pad put on a table. In examples of sizes thereof, the diameter ϕ of the drum pad 10 is 260 mm and the thickness t thereof is 20 mm, but the invention is not limited to the examples.

FIG. 1(*b*) is a sectional view schematically illustrating a configuration of the drum pad 10. As shown in FIG. 1(*b*), the drum pad 10 includes a composite layer 20M2 that is formed on a surface 14*a* of a body portion 14 and that includes a first layer portion 21 and a second layer portion 22M2.

A surface 20Ma of the composite layer 20M2 is the top surface, that is, the beating surface 10*a*, of the drum pad 10. A rear surface 20Mb of the composite layer 20M2 is bonded to the surface 14*a* of the body portion 14. The first layer portion 21 and the second layer portion 22M2 in the composite layer 20M2 are partitioned vertically by a boundary portion 23. The second layer portion 22M2 occupies a remaining region other than the first layer portion 21 in the composite layer 20M2. The top surface 20Ma and the rear surface 20Mb of the composite layer 20M2 are flat, but the boundary portion 23 cannot be said to be flat.

FIGS. 2(*a*) to 2(*d*) are diagrams schematically illustrating a process of manufacturing a drum pad 10. FIGS. 2(*a*) and 2(*b*) show sectional views of a first surface material 12 and a second surface material 20, respectively, and FIG. 2(*c*) shows a sectional view of a temporary composite layer in a state before the composite layer 20M2 is completely formed. FIG. 2(*d*) shows a sectional view illustrating a molding process using a mold.

The drum pad 10 includes the first surface material 12, the second surface material 20, and a rubber material 13 as a molding material. The first surface material 12 and the second surface material 20 are much thinner than the body portion 14, and the first surface material 12 is thinner than the second surface material 20.

A knitted material as a material stretchable (2-way stretchable) in all two-dimensional directions is suitable for the second surface material 20 (see FIG. 2(*b*)), but unwoven cloth may be used therefor. By using these materials, the rebounding and returning direction of a stick 11 is similar to an acoustic stick.

Here, the knitted material means a kind of cloth obtained by connecting loops having a curved-yarn shape horizontally or vertically, and an example thereof is knitted cloth. The unwoven cloth means cloth in which fibers are coupled to each other without being woven or knitted. The kind of fibers is not limited and unwoven cloth formed of natural fiber or synthetic fiber may be used.

As the first surface material 12 (see FIG. 2(*a*)), a stretchable film-like resin material capable of being thermally fused and bonded to the second surface material 20, for example, polyurefin, is employed. In addition, polyurethane resin may be employed or mixture of polyurethane and polyester or mixture of polyurethane and nylon may be employed.

As the rubber material 13 (see FIG. 2(*d*)), silicon rubber having a siloxane bond, for example, foamy silicon RTV rubber, is suitably used. In this embodiment, KE521(A/B) (trademark) which is two-liquid RTV rubber made by ShinEtsu Silicon Co., Ltd. was employed at the time of molding.

A method of manufacturing the drum pad 10 will be described now.

First, the first surface material 12 and the second surface material 20 are prepared with a predetermined shape (for example, a circular shape) and a predetermined thickness (see FIGS. 2(*a*) and 2(*b*)). The thickness of the first surface material 12 is about 0.1 mm and the thickness of the second surface material 20 is about 0.2 mm. The circular shape of the first surface material 12 and the second surface material 20 in a plan view is obtained. Otherwise, the material may be cut later in a circular shape along with the body portion 14 after molding the body portion 14.

The rear surface 12*b* of the first surface material 12 is thermally fused and bonded to the top surface 20*a* of the second surface material 20. This is performed by allowing an overlapped structure of the first surface material 12 and the second surface material 20 to pass through two heated rollers.

Here, the melting point of the first surface material 12 is lower than that of the second surface material 20. In addition, the first surface material 12 is thinner than the second surface material 20. Accordingly, when the overlapped structure is fused and bonded at a temperature at which the first surface material 12 is melted, as shown in FIG. 2(*c*), the melted first surface material 12 deeply permeates the region including the top surface 20*a* of the second surface material 20. The region is a depth region from the surface 20*a* to the boundary portion 23 corresponding to the thickness of the first surface material 12. When it is cooled in this state, the first layer portion 21 is formed in the region where the first surface material 12 deeply permeates by monolithically solidifying the first surface material 12 and the upper half of the second surface material 20. On the other hand, the remaining region (a depth region from the boundary portion 23 to the rear surface 20*b* of the second surface material 20) of the second surface material 20 other than the first layer portion 21 becomes the temporary second layer portion (provisional second layer portion, or pre second layer portion) 22M1 formed of only the knitted material.

In the temporary composite layer 20M1 (provisional composite layer or pre composite layer) formed in this way, the surface 20*a* of the second surface layer 20 also serves as the surface 20Ma of the first layer portion 21 formed by deep permeation of the first surface material 12. On the other hand, the rear surface 20*b* of the second surface material 20 serves as the rear surface 20Mb of the temporary composite layer 20M1.

Then, as shown in FIG. 2(*d*), the temporary composite layer 20M1 is put into a mold 24 and the rubber material 13 is cast to the rear surface 20Mb of the temporary composite layer 20M1 to mold the body portion 14. Specifically, liquid material A and liquid material B as the two-liquid type RTV (Room Temperature Vulcanization) rubber are weighed and mixed well. Then, the mixture of materials A and B are injected into the mold 24, the mold 24 is closed, and the mixture is foamed and solidified at a room temperature. A space S1 in the mold 24 close to the rear surface 20Mb of the temporary composite layer 20M1 is filled with the foamed rubber material 13.

At the time of foaming the rubber material 13, the rubber material 13 is impregnated into the region of the temporary second layer portion 22M1 from the rear surface 20Mb of the temporary composite layer 20M1. However, since the first surface material 12 deeply permeates the first layer portion 21, the first layer portion is not impregnated with the rubber material 13, but the impregnation is stopped at the boundary portion 23. In this meaning, the first layer portion 21 serves as a stopper for not exposing the rubber material 13 from the surface 20Ma of the temporary composite layer 20M1. Thereafter, an anneal process is performed.

Accordingly, the temporary second layer portion 22M1 becomes the second layer portion 22M2 impregnated with the rubber material 13, and the final composite layer 20M2 is formed by the second layer portion 22M2 and the first layer portion 21 as shown in FIG. 1(*b*). The rear surface 20Mb of the composite layer 20M2 is bonded to the top surface 14*a* of the body portion formed of the foamed and solidified rubber material 13. Since the portion impregnated with the rubber material 13 is in contact with the body portion 14, and fibers of fibrous material selected from the knitted cloth and the unwoven cloth continue across both layers, the bonding strength is great. In addition, since an adhesive agent for the bonding is not necessary, the manufacturing method is simple. The configuration and direction of the mold 24 are not limited to the example.

Figure 3:
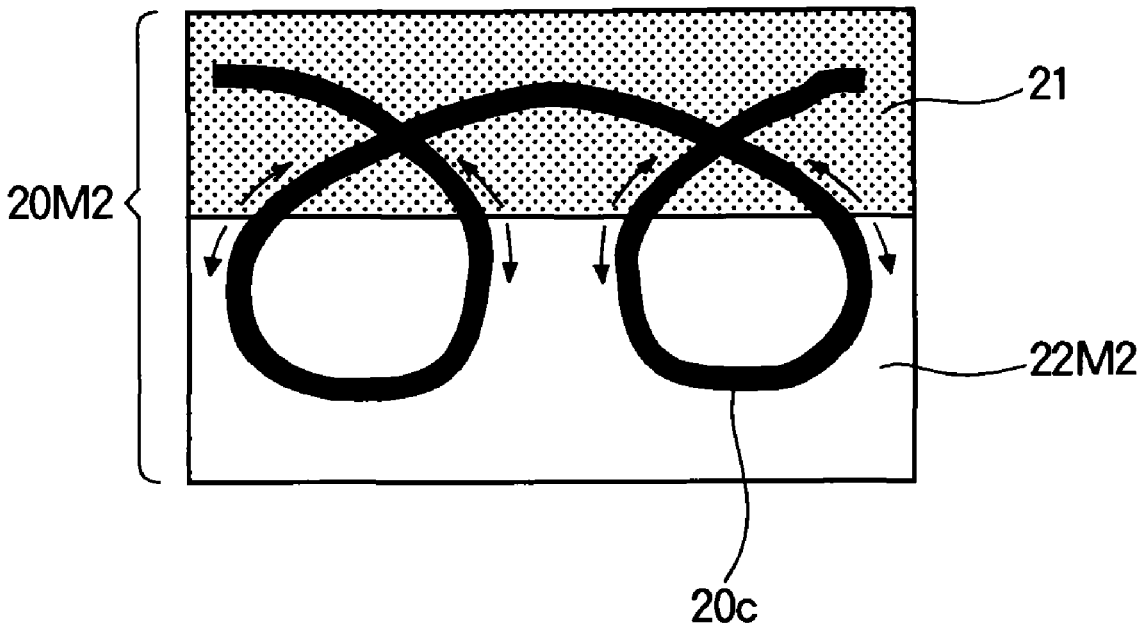
FIG. 3 is a diagram schematically illustrating a composite layer.

FIG. 3 is a diagram schematically illustrating the final composite layer 20M2. Since the fiber 20*c* of the second surface material 20 deeply permeates the first layer portion 21 and the second layer portion 22M2 and serves as an anchor, the fiber serves as a bridge binding two layers to accomplish the reinforcement. Accordingly, since the first layer portion 21 is hardly separated from the second layer portion 22M2 and both layers are fibered and reinforced, both layers are hardly torn down or broken at the time of beating the pad. These are true when the second surface material 20 is formed of knitted cloth or unwoven cloth.

At the time of beating the beating surface 10*a*, a great stretchable property can be obtained due to the two-way stretchable property of the second surface material 20 in addition to the stretchable property of the first surface material 12. Accordingly, since the beating portion is locally deformed and has a great restoring force, the beating feeling is not hard and the stick 11 rebounds well.

According to this embodiment, the first surface material 12 is thermally fused and bonded to the second surface material 20 to form the temporary composite layer 20M1, and the rubber material 13 is foamed and solidified on the rear surface 20Mb side of the temporary composite layer 20M1 to shape the body portion 14. Accordingly, the composite layer 20M2 is formed by the first layer portion 21 where the first surface material 12 deeply permeates and the second layer portion 22M2 impregnated with the rubber material 13.

Since the body portion 14 is formed of the rubber material 13 such as silicon rubber, the rebound coefficient is great and the beating feeling gets better. In addition, since the composite layer 20M2 is basically formed of knitted cloth, the rebounding and returning direction of the stick 11 is similar to that of the acoustic drum, thereby embodying the natural beating feeling. In addition, since the first layer portion 21 formed by solidifying the deeply-permeated first surface material 12 provides the beating surface 10*a*, it is possible to improve the quietness of the beating action and the resistance to the beating action. In addition, since the knitted material is protected by the first surface material 12, it is possible to further prevent the contamination. Accordingly, it is possible to prevent the contamination of the beating surface 10*a* and to maintain the durability and it is also possible to embody the natural and good beating feeling.

In this embodiment, the body portion 14 employs the rubber material 13 so as to enhance the beating feeling and the weathering resistance. It is generally difficult to bond an urethane film to silicon rubber. However, in this embodiment, since the bonding to the body portion 14 is carried out with the second surface material 20 such as the knitted material, it is easy to employ the silicon rubber.

When the rubber material 13 is impregnated into the second surface material 20, it can be considered that the impregnation speed is irregular by positions. However, in this embodiment, since the first layer portion 21 has a function of stopping the impregnation of the rubber material 13 at the boundary portion 23, the irregularity in impregnation does not occur. Accordingly, the beating surface 10*a* can be made to be smooth and uniform in characteristics.

Second Embodiment

Figure 4:
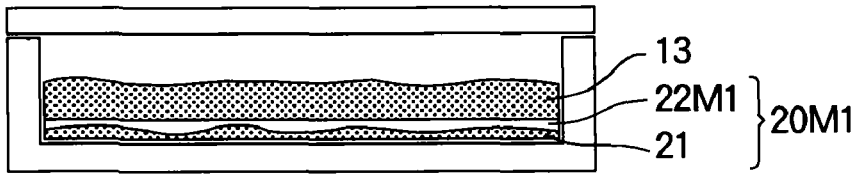
FIGS. 4(*a*) and 4(*b*) are sectional views schematically illustrating a process of molding a drum pad according to a second embodiment of the invention using a mold, and FIGS. 4(*c*) and 4(*d*) are sectional views schematically illustrating a process of molding a drum pad according to a third embodiment of the invention using a mold.
Figure 4:
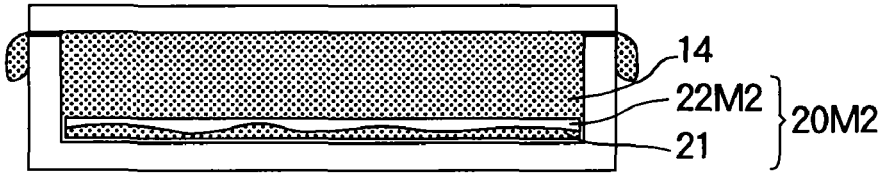
Figure 4:
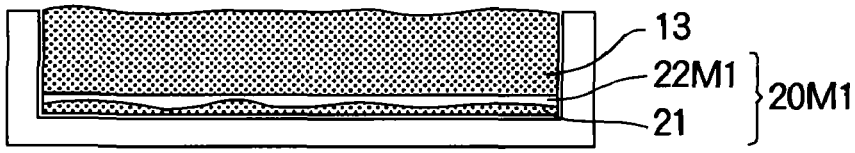
Figure 4:
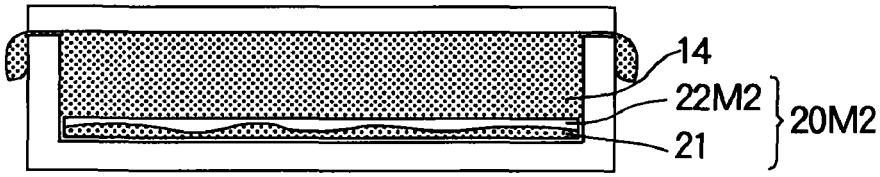

FIGS. 4(*a*) and 4(*b*) are sectional views schematically illustrating a process of molding a drum pad according to a second embodiment of the invention using a mold.

In the first embodiment, the temporary composite layer 20M1 is set on the ceiling side of the mold at the time of molding. However, in the second embodiment, the temporary composite layer 20M1 is set on the bottom side of the mold so that the temporary second layer portion 22M1 is directed to the upside. The other configurations are similar to those of the first embodiment.

As shown in FIG. 4(*a*), the rubber material 13 as a resin material is cast onto the temporary composite layer 20M1. Similarly to the first embodiment, when the mold is pressurized and heated, the rubber material 13 is foamed and solidified (see FIG. 4(*b*)). A part of the rubber material 13 protrudes from a gap between the lower mold and the upper lid mold. It is similar to the first embodiment that the temporary second layer portion 22M1 becomes the permanent second layer portion 22M2 by the impregnation of the rubber material 13.

According to this embodiment, the same advantages as the first embodiment can be obtained.

Third Embodiment

FIGS. 4(*c*) and 4(*d*) are sectional views schematically illustrating a process of molding a drum pad according to a third embodiment of the invention using a mold.

In the first and second embodiments, the foamed rubber is employed as the rubber material 13. However, in the third embodiment, non-foamed rubber is employed. For example, non-foamed silicon rubber formed by not foaming but solidifying liquid silicon or non-foamed urethane rubber formed by not foaming but solidifying liquid urethane resin is employed. The other is similar to the second embodiment.

As shown in FIG. 4(*c*), the rubber material 13 as the non-foamed resin is cast onto the temporary composite layer 20M1. Then, when the lid mold is closed and the resultant structure is pressurized, heated, and then solidified, the entire shape is defined by the lid mold to shape the body portion 14 (see FIG. 4(*d*)). An excessive of the rubber material 13 may overflow or squeezed from a gap between the lower mold and the lid mold. It is similar to the first embodiment that the temporary second layer portion 22M1 becomes the second layer portion 22M2 by the impregnation of the rubber material 13.

According to this embodiment, the same advantages as the first embodiment can be obtained.

Fourth Embodiment

Figure 5:
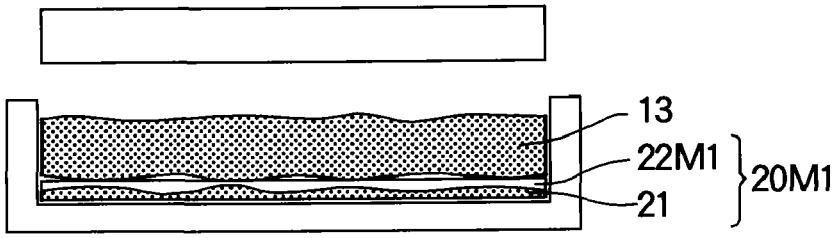
FIGS. 5(*a*) and 5(*b*) are sectional views schematically illustrating a process of molding a drum pad according to a fourth embodiment of the invention using a mold, and FIGS. 5(*c*) to 5(*e*) are sectional views schematically illustrating a process of molding a drum pad according to a fifth embodiment of the invention using a mold.
Figure 5:
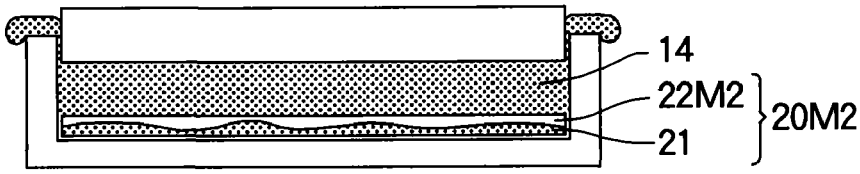
Figure 5:
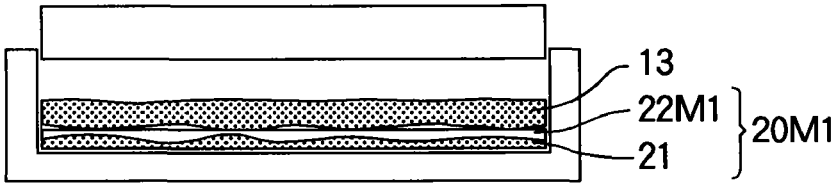
Figure 5:
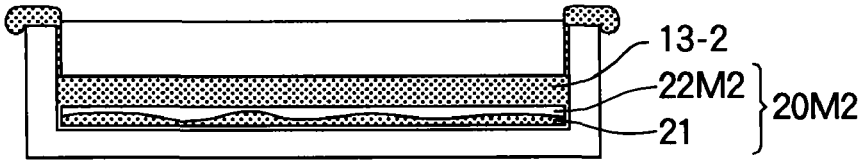
Figure 5:
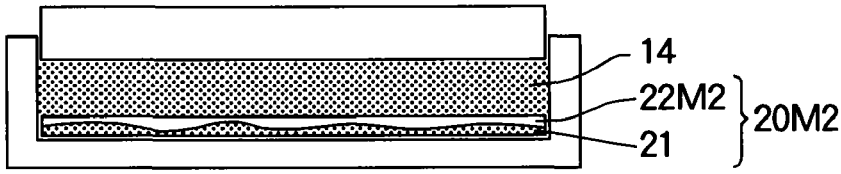

FIGS. 5(*a*) and 5(*b*) are sectional views schematically illustrating a process of molding a drum pad according to a fourth embodiment of the invention using a mold. In the first to third embodiments, liquid resin is employed as the rubber material 13. However, non-vulcanized rubber compound may be employed.

In this embodiment, a rubber material mainly including NR (natural rubber) and BR (butadiene rubber) is employed as the rubber material 13. The mixture ratio of the rubber material is as follows: as additive materials to NR of 40 wt % and BR of 60 wt %, zinc oxide is 3 wt %, stearic acid is 1 wt %, sulfur is 6 wt %, calcium carbide is 15 wt %, and carbon is 10 wt %, as additive materials. These are kneaded by the use of a roll to produce the rubber material 13 as a compound.

As shown in FIG. 5(*a*), the rubber material 13 as the non-foamed and non-vulcanized rubber compound is put onto the temporary composite layer 20M1. As shown in FIG. 5(*b*), the lid mold is closed and the resultant structure is pressurized and heated at 160° C. for 10 minutes. At this time, the rubber material 13 is first softened and impregnated into the temporary second layer portion 22M1, and thus the temporary second layer portion 22M1 becomes the final second layer portion 22M2. A part of the rubber material 13 protrudes from a gap between the lower mold and the lid mold. The vulcanization is performed to obtain the body portion 14 as elastic rubber.

According to this embodiment, the same advantages as the first embodiment can be obtained.

Fifth Embodiment

FIGS. 5(*c*), 5(*d*), and 5(*e*) are sectional views schematically illustrating a process of molding a drum pad according to a fifth embodiment of the invention using a mold. In the fifth embodiment, non-vulcanized rubber compound is employed as the rubber material 13.

In this embodiment, a material obtained by adding a foaming agent (for example, 4,4'-oxybisbenzene sulfonyl hydralazide (of which the decomposition temperature is 160° C.)) of 4 wt % to the material employed in the fourth embodiment is employed as the rubber material 13. These are kneaded by the use of a roll to produce the rubber material 13 as a compound.

As shown in FIG. 5(*c*), the rubber material 13 as the non-foamed and non-vulcanized rubber compound is put onto the temporary composite layer 20M1. As shown in FIG. 5(*d*), the lid mold is closed and the resultant structure is pressurized and heated at 160° C. for 10 minutes. At this time, the rubber material 13 is first softened and impregnated into the temporary second layer portion 22M1 and thus the temporary second layer portion 22M1 becomes the permanent second layer portion 22M2. The rubber material 13 becomes a soft rubber material 13-2 and a part thereof protrudes from a gap between the lower mold and the lid mold.

Thereafter, as shown in FIG. 5(*e*), since the soft rubber material 13-2 starts foaming and vulcanization at the same time, the pressure of the mold is made to slowly decrease. Then, the soft rubber material 13-2 expands due to the foaming pressure and fills the space in the mold, thereby obtaining the body portion 14.

According to this embodiment, the same advantages as the first embodiment can be obtained.

As described in the embodiments, the material employed by the body portion 14 is not limited to the foamy silicon rubber, but may be non-silicon rubber or non-foamy rubber. For example, urethane rubber, natural rubber, butadiene rubber, and the like may be employed in view of the foaming property. Silicon rubber, urethane rubber, natural rubber, butadiene rubber, and the like may be employed in view of the non-foaming property.

What is claimed is:

1. A drum pad comprising: a knitted material that is strechable and has a top surface to be beaten by a stick and a rear surface opposite to the top surface; a resin member that is strechable and thinner than the knitted material and that is capable of being thermally fused and bonded to the knitted material; and a rubber, wherein the drum pad has a first layer portion, a second layer portion, and a body portion, wherein the first layer portion is formed in a region of the knitted material including the top surface thereof but not including the rear surface, and is permeated with the melted resin member such that the resin member and the knitted material monolithically solidify with each other, the body portion is formed of the rubber, and the second layer portion is formed in a remaining region of the knitted material other than the first layer portion and formed between the body portion and the first layer portion, the second layer portion being impregnated with the rubber such that the body portion is bonded to the rear surface of the knitted material.

2. The drum pad according to claim 1, wherein the rubber is foamed rubber.

3. The drum pad according to claim 1, wherein the rubber is silicon rubber having a siloxane bond.

4. A drum pad comprising: an unwoven cloth that is strechable and has a top surface to be beaten by a stick and a rear surface opposite to the top surface; a resin member that is strechable and thinner than the unwoven cloth material and that is capable of being thermally fused and bonded to the unwoven cloth; and a rubber, wherein the drum pad has a first layer portion, a second layer portion, and a body portion, wherein the first layer portion is formed in a region of the unwoven cloth including the top surface thereof but not including the rear surface, and is permeated with the melted resin member such that the resin member and the unwoven cloth monolithically solidify with each other, the body portion is formed of the rubber, and the second layer portion is formed in a remaining region of the unwoven cloth other than the first layer portion and formed between the body portion and the first layer portion, the second layer portion being impregnated with the rubber such that the body portion is bonded to the rear surface of the unwoven cloth.

5. The drum pad according to claim 4, wherein the rubber is foamed rubber.

6. The drum pad according to claim 4, wherein the rubber is silicon rubber having a siloxane bond.

7. A method of manufacturing a drum pad including a knitted material that is strechable and that has a top surface to be beaten by a stick and a rear surface opposite to the top surface, a resin member that is strechable and thinner than the knitted material and that is capable of being thermally fused and bonded to the knitted material, and a rubber, wherein the method comprises:

a thermal fusion and bonding process of thermally fusing and bonding the resin member to the top surface of the knitted material and forming a first layer portion by allowing the melted resin member to permeate a region of the knitted material including the top surface but not including the rear surface of the knitted material so that the resin member and the knitted material monolithically solidify with each other; and a molding process of forming a second layer portion impregnated with the rubber in a remaining region of the knitted material other than the first layer portion and concurrently forming a body portion with the rubber below the second layer portion oppositely to the first layer portion, and bonding the body portion to the rear surface of the knitted material by casting liquid resin material or thermally-softened non-vulcanized rubber as material of the rubber from the rear surface above which the first layer portion is formed.

8. The method according to claim 7, wherein the rubber is foamed rubber.

9. The method according to claim 7, wherein the rubber is silicon rubber having a siloxane bond.

10. A method of manufacturing a drum pad including an unwoven cloth that is strechable and that has a top surface to be beaten by a stick and a rear surface opposite to the top surface, a resin member that is strechable and thinner than the unwoven cloth and that is capable of being thermally fused and bonded to the unwoven cloth, and a rubber, wherein the method comprises:

a thermal fusion and bonding process of thermally fusing and bonding the resin member to the top surface of the unwoven cloth and forming a first layer portion by allowing the melted resin member to permeate a region of the unwoven cloth including the top surface but not including the rear surface of the unwoven cloth so that the resin member and the unwoven cloth monolithically solidify with each other; and a molding process of forming a second layer portion impregnated with the rubber in a remaining region of the unwoven cloth other than the first layer portion and concurrently forming a body portion with the rubber below the second layer portion oppositely to the first layer portion, and bonding the body portion to the rear surface of the unwoven cloth by casting liquid resin material or thermally-softened non-vulcanized rubber as material of the rubber from the rear surface above which the first layer portion is formed.

11. The method according to claim 10, wherein the rubber is foamed rubber.

12. The method according to claim 10, wherein the rubber is silicon rubber having a siloxane bond.

* * * * *